US005390005A

United States Patent [19]

Kimoto et al.

[11] Patent Number: 5,390,005

[45] Date of Patent: Feb. 14, 1995

[54] OPERATION-PANEL-INDICATING METHOD FOR A COPYING MACHINE

[75] Inventors: Tetsuo Kimoto; Tetsuo Hirata; Yoshikazu Maekawa, all of Hachioji, Japan

[73] Assignee: Konica Corporation, Japan

[21] Appl. No.: 86,231

[22] Filed: Jul. 1, 1993

[30] Foreign Application Priority Data

| | | | |
|---|---|---|---|
| Jul. 13, 1992 | [JP] | Japan | 4-185490 |
| Jul. 13, 1992 | [JP] | Japan | 4-185491 |
| Jul. 13, 1992 | [JP] | Japan | 4-185492 |
| Jul. 13, 1992 | [JP] | Japan | 4-238681 |
| Jul. 13, 1992 | [JP] | Japan | 4-239840 |

[51] Int. Cl.[6] ..... G03G 21/00

[52] U.S. Cl. ..... 355/209; 345/173; 355/313

[58] Field of Search ..... 355/200, 204, 209, 206, 355/313, 309; 364/146, 188; 340/825.22, 825.17; 345/173, 902, 115; 434/227, 228, 231, 118

[56] References Cited

U.S. PATENT DOCUMENTS

| | | | |
|---|---|---|---|
| Re. 32,253 | 9/1986 | Bartulis et al. | 355/209 |
| 4,597,662 | 7/1986 | Hirato et al. | 355/209 |
| 4,870,459 | 9/1989 | Ito et al. | 355/209 |
| 5,036,361 | 7/1991 | Filion et al. | 355/209 |
| 5,045,880 | 9/1991 | Evanitsky et al. | 355/209 X |
| 5,049,931 | 9/1991 | Knodt | 355/209 |
| 5,061,958 | 10/1991 | Bunker et al. | 355/309 X |
| 5,105,220 | 4/1992 | Knodt et al. | 355/209 |
| 5,113,222 | 5/1992 | Wilson et al. | 355/313 X |
| 5,182,796 | 1/1993 | Shibayama et al. | 355/209 X |
| 5,185,628 | 2/1993 | Wilson et al. | 355/209 |

FOREIGN PATENT DOCUMENTS

| | | | |
|---|---|---|---|
| 0030160 | 6/1981 | European Pat. Off. | 345/173 |
| 4-101171 | 4/1992 | Japan | 355/209 |

*Primary Examiner*—A. T. Grimley
*Assistant Examiner*—Shuk Y. Lee
*Attorney, Agent, or Firm*—Bierman and Muserlian Jordan B. Bierman

[57] ABSTRACT

A method of indicating a setting screen of an image forming machine on which a touch-panel is displayed, wherein automatic setting conditions and a manual mode button are displayed on an initial screen; and when a touch operation is conducted on the manual mode button, a manual setting screen is indicated and an operating condition can be manually set by a touch operation on the manual setting screen.

7 Claims, 13 Drawing Sheets

OPERATION-PANEL-INDICATING METHOD FOR A COPYING MACHINE

BACKGROUND OF THE INVENTION

The present invention relates to a method for indicating an operation panel where various copying conditions are set in a copying machine.

For a copying machine, there has been available an operation panel provided with a screen which serves also as a touch-panel that is a panel capable of being touched by a finger for setting copy conditions, on which a setting screen provided with various buttons is displayed to be touched for manual setting of various copying conditions (Japanese Patent Publication Open to Public Inspection No. 282916/1986 (hereinafter referred to as Japanese Patent O.P.I. Publication).

In such a conventional copying machine, however, all buttons for manual setting such as settings of density, sheet size, duplex copying and others, for example, are displayed from the beginning of operation, although the copying machine can operate for copying basically through automatic setting. Therefore, a user used to bear ill feeling that the operation must be complicated and troublesome.

In view of the situation mentioned above, the first object of the invention is to provide an operation-panel-indicating method for a copying machine that indicates a simple screen in the initial stage and indicates a necessary screen in the case of manual setting.

Even in the case of a copying machine of the above-mentioned type, when selecting a copy sheet, priority has been given mainly to a sheet size and therefore, a sheet of different size has been selected for a push of a button. Accordingly, it has been impossible for a user to tell, at a glance, what type of sheet is set, and it has been further impossible to select the kinds other than a size of a sheet.

In view of the situation mentioned above, the second object of the invention is to provide an operation-panel-indicating method that is optimum when setting screen is indicated, for selection of a copy sheet, on a screen that serves also as a touch-panel provided as an operation panel on a copying machine.

Even in the case of a copying machine of the type mentioned above, a user used to bear ill feeling that an operation is difficult to understand, complicated and troublesome because each button representing each function has been simply arranged.

In view of the situation mentioned above, the third object of the invention is to provide an operation-panel-indicating method that is optimum when a setting screen including a plurality of buttons is indicated, for inputting, on a screen that serves also as a touch-panel provided as an operating panel on a copying machine.

The fourth object of the invention is to provide an indicating method wherein conditions for post processing can be set especially through a simple arrangement and confirmation after the setting can easily be made, while securing visibility and an easy operation on a setting screen, in an operation panel where the setting screen for selecting copying conditions is indicated, on a switchover basis, on a screen that serves also as a touch-panel for setting copying conditions through touching on the screen.

The fifth object of the invention is to attain that confirmation of selected and set conditions and selection from a plurality of registered copying conditions are easily made in an operation panel where a setting screen for selecting copying conditions is indicated, on a switchover basis, on a screen that serves also as a touch-panel for setting copying conditions through touching on the screen.

SUMMARY OF THE INVENTION

For attaining the first object in the invention, when a setting screen is indicated, for inputting, on the screen that serves also as a touch-panel provided as an operation panel on a copying machine, conditions set automatically as well as a button for switching to manual setting are indicated on the screen in the initial stage, and after an operation of touching the button mentioned above, the setting screen for manual setting is indicated.

Further, in the course of copying, a manual setting screen is indicated automatically and it returns to the initial screen after the completion of copying.

Namely, the initial screen is required to be simple, indicating the conditions automatically set and only a button for switching to manual setting.

In the case of manual setting, when a button is touched on the initial screen, it is changed to a manual setting screen to make the detailed setting possible.

Further, when a copy button is pressed, a manual setting screen is indicated automatically, and a user can confirm the values set by various automatic selecting mechanisms. Then, after the completion of copying, the screen returns automatically to an initial screen.

For attaining the second object in the invention, when a setting screen is indicated, for selection of a copy sheet, on the screen that serves also as a touch-panel provided as an operation panel on a copying machine, illustration of the total copying machine including arrangement of a plurality of sheet-feeding trays are indicated on the screen for the selection from the sheet-feeding trays shown in the illustration by means of a touch operation.

Namely, when selecting a copy sheet, illustration enables a user to recognize, at a glance, what kind of copy sheet is set and to select the kinds of sheets in addition to a sheet size when a sheet-feeding tray is selected directly. Further, an indication of a sheet size or a sheet type on a sheet-feeding tray in the illustration may make the selection easy.

For attaining the third object in the invention, when a setting screen including a plurality of buttons is indicated, for inputting, on the screen that serves also as a touch-panel provided as an operation panel on a copying machine, buttons which can not exist in terms of function are required to be correlated with each other for indication thereof.

Namely, buttons whose functions can not exist together on the screen, in other words, exclusive input buttons are required to be grouped to show that they are related with each other, for the purpose of making the operation to be easily understood.

For attaining the fourth object mentioned above, an operation-panel-indicating method of a copying machine related to the invention is one indicating a setting screen for selection of copying conditions on a screen that serves also as a touch-panel provided as an operation panel of the copying machine, on a switchover basis, and thereby causing copying conditions to be set through a touch operation on the screen, wherein a button for indicating a setting screen for selection of post processing for copied sheet is provided outside the aforementioned screen and the screen is changed for indication to the setting screen for the post processing by the button operated, and post processing conditions selected on the setting screen for post processing are indicated as an indicator mark at a predetermined position on a setting screen other than the setting screen for the post processing.

In the operation-panel-indicating method structured in the way mentioned above, when setting the post processing for a copy sheet manually, a button provided outside a screen is operated. Then, the screen is changed to a setting screen for selecting the post processing, thus, the post processing is set manually through an operation of touching the setting screen. In this case, when the setting screen for post processing is changed to a setting screen for other copying conditions, post processing can not be set manually. However, the results of the setting are indicated as indicator marks at a predetermined,position on the other setting screen after changing so that the situation of the setting for the post processing may be confirmed even under the condition that a setting screen for those other than the post processing is indicated.

For attaining the five object mentioned above, an operation-panel-indicating method of a copying machine related to the invention is one indicating a setting screen for selection of copying conditions on a screen that serves also as a touch-panel provided as an operation panel of the copying machine, on a switchover basis, and thereby causing copying conditions to be set through a touch operation on the screen, wherein a check button for instructing a changeover to a screen indicating a table of the copying conditions set is provided outside the screen so that the setting screen may be changed to a screen that indicates a table of the copying conditions set through an operation of the check button.

Further, in the structure mentioned above, when storing various copying conditions, there are displayed, on the screen, key boards representing alphabets and numerals which are touched for input of registered names, while, when selecting from the stored various copying conditions, there is displayed, on the screen, a table containing the stored various copying conditions shown in registered names.

In the operation-panel-indicating method having the structure mentioned above, when a check button is operated, a screen is changed to one indicating a table that shows how various copying conditions have been set, and it is possible to confirm all copying conditions by using the screen.

Further, when storing various copying conditions which have been set manually, there are displayed, on the screen, key boards for inputting registered names. It is possible to give a given registered name to each of manually-set various copying conditions by touching the key boards, and registered copying conditions are displayed, in registered names given on the occasion of registration, in the form of a table on the screen. Therefore, it is possible to use the aforementioned registered name as a clue for an access to the desired copying condition.

DETAILED DESCRIPTION OF THE PREFERRED EMBODIMENT

Figure 1:
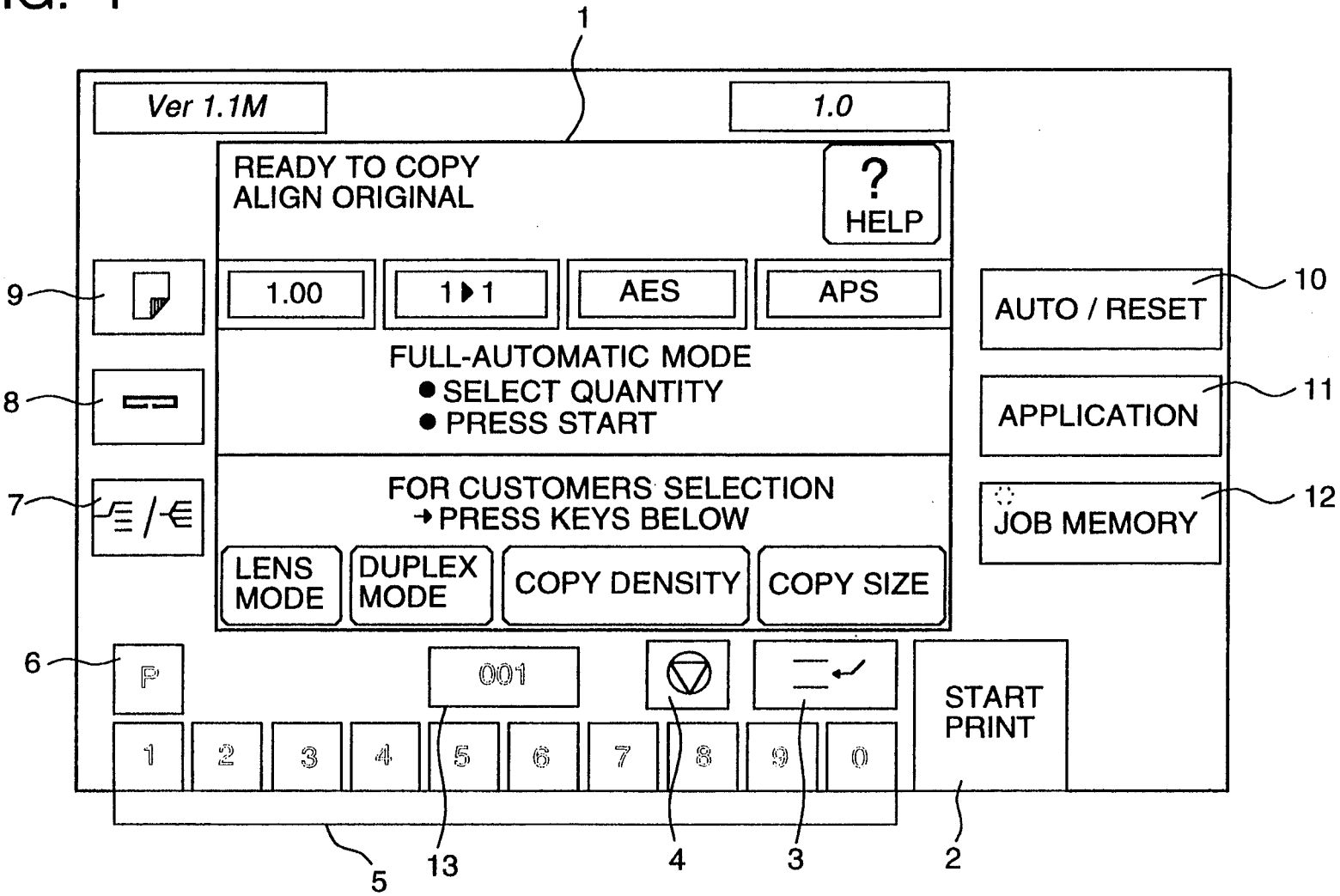
FIG. 1 is a general view of an operation panel showing an example of the invention.

Examples of the invention will be explained as follows, referring to the drawings.

FIG. 1 shows an entire operation panel of a copying machine, and a part marked with the numeral 1 is an LCD screen that serves also as a touch-panel. Ordinary buttons are arranged around the LCD 1. The numeral 2 is a copy button which is used for execution of copying, and 3 is an interruption button which is used for urgent copying that interrupts regular copying. The numeral 4 is a stop/clear key which is used for suspension of copying work or for resetting of the number of copies. The numeral 5 is a ten-key to be used for setting quantity of copies, and 6 is a P-button that is used for specific operation. The numeral 7 represents a sorter button which conducts switchover of a sort-mode, a group-mode and a manual-mode, and when it is selected, a display is reversed. The numeral 8 is a staple-mode button that performs setting and canceling of the staple-mode, and when it is selected, a display is reversed. The numeral 9 is a reverse-sheet-ejection button that performs setting and canceling of the mode of reverse-sheet-ejection, and when it is selected, a display is reversed. The numeral 10 is an automatic mode button which initializes various kinds of set modes including a copy mode, and when it is selected, a display is reversed, and 11 is an application button which conducts a transfer to an applied-selection screen, and when it is selected, a display is reversed. The numeral 12 is a job-button which conducts a transfer to a job-selection screen, and when it is selected, a display is reversed, and 13 is a copy-quantity counter.

Contents of LCD screen 1 will be explained as follows.

Figure 2:
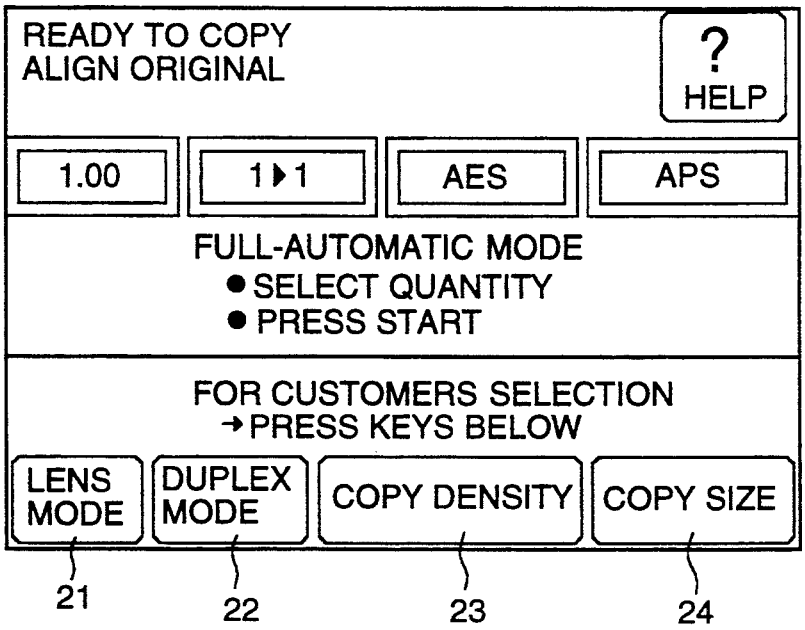
FIG. 2 is a diagram showing the initial screen.

Upon completion of warm-up after the power source is turned on, a copying machine is caused to be on a full-automatic mode, and an initial screen shown in FIG. 2 appears on the LCD screen 1. Incidentally, FIG. 2 shows only LCD screen 1 among those shown in FIG. 1. It is recommendable that contrast and back light of the LCD screen 1 can be adjusted on an operation panel.

An initial screen in FIG. 2 represents a full-automatic screen which shows that magnification of one time (1.00), one side → one side copying (1→1), automatic density adjustment (AES), automatic paper selection (APS) have been set automatically.

Further, four buttons 21–24 for transferring to manual setting are displayed on the lowermost step. The numeral 21 represents a lens mode button, 22 is a duplex mode button, 23 is a copy density button and 24 is a copy size button.

In addition to the above, a message showing the state of the copying machine and showing operation procedures to a user is displayed on a message area.

Figure 3:
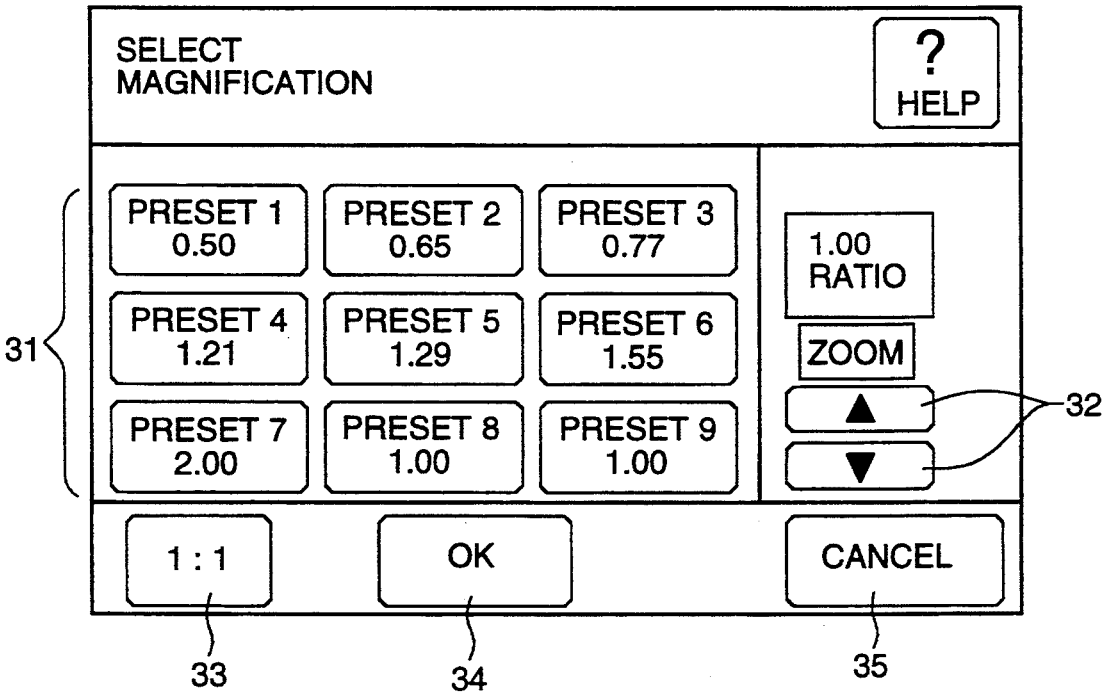
FIG. 3 is a diagram showing a magnification-setting screen.

When the lens mode button 21 is pressed on the initial screen shown in FIG. 2, magnification-selection screen in FIG. 3 is displayed.

In the magnification-selection screen in FIG. 3, there are displayed buttons 31 for various magnifications. Therefore, a button showing a necessary magnification or one showing the magnification close to that necessary magnification is to be selected and pressed. When the magnification requires adjustment, up/down buttons 32 may be used for adjustment. For the magnification of one time, "1:1" button 33 may also be pressed.

When completing setting, OK button 34 is to be pressed and when canceling setting on the half way, cancel button 35 is to be pressed. Either of these occasions causes a screen to return to basic screen (shown in FIG. 4) which will be stated later.

Figure 4:
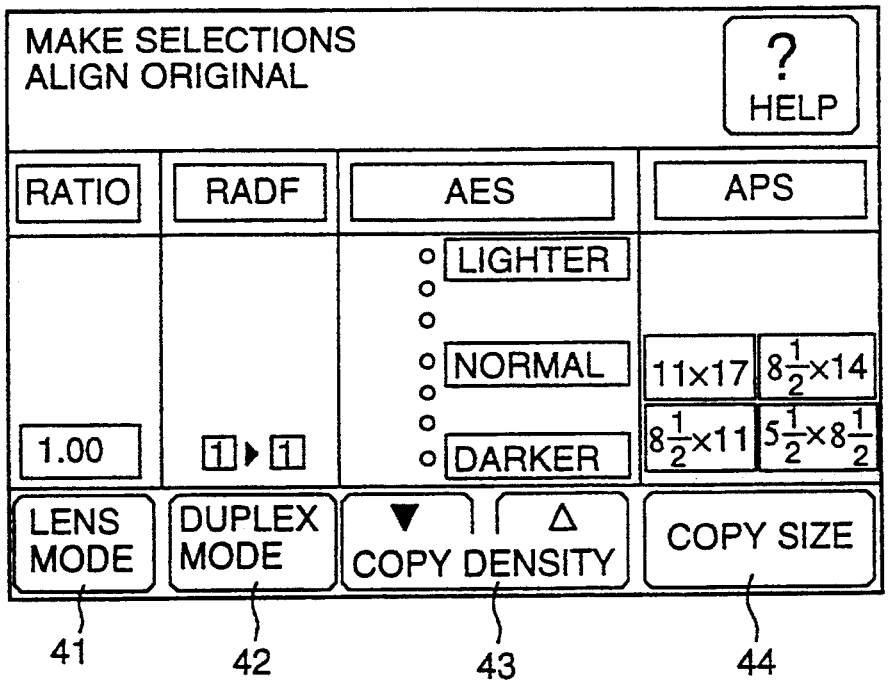
FIG. 4 is a diagram showing a basic screen.

When duplex mode button 22 or copy density button 23 is pressed on the initial screen in FIG. 2, basic screen in FIG. 4 is displayed.

On the basic screen in FIG. 4, there are displayed lens mode button 41, duplex mode button 42, copy density button 43 and copy size button 44.

When the lens mode button 41 is pressed in this case, a screen is transferred to magnification-selection screen (shown in FIG. 3) mentioned above.

Each time the duplex mode button 42 is pressed, a screen is switched in the sequence of one side → one side (1→1), one side → duplex (1→2), duplex → one side (2→1), duplex → duplex (2→2).

It is possible to adjust density by means of copy density button 43 wherein a button for enhancing density and a button for lowering density are provided.

When copy size button 44 is pressed, a screen is transferred to tray-selection screen (shown in FIG. 5) which will be stated later.

Figure 5:
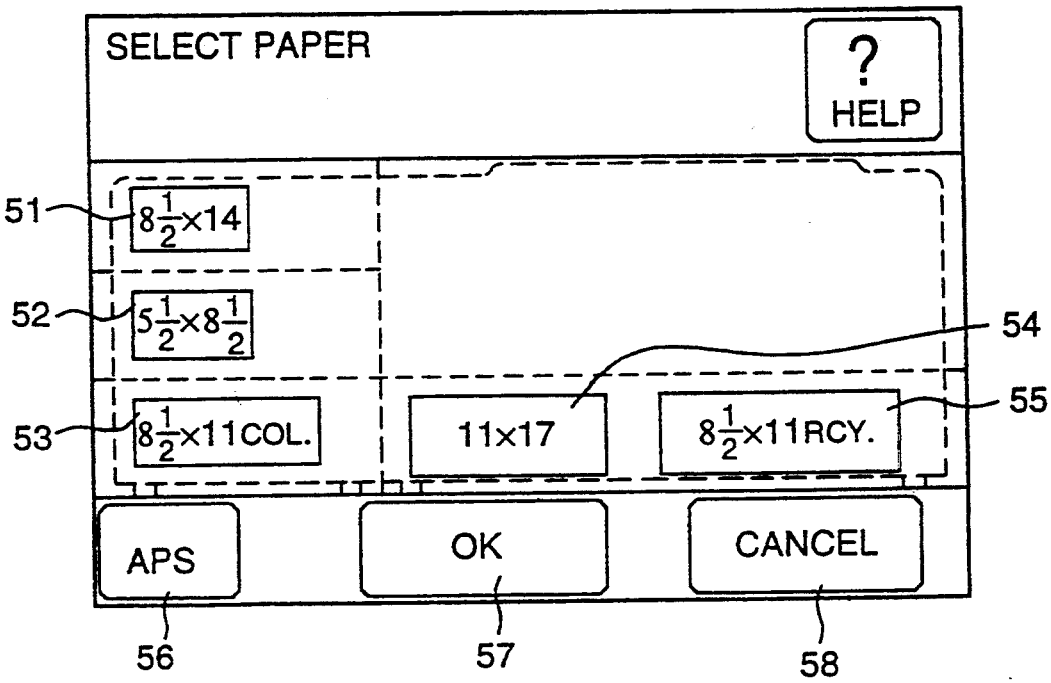
FIG. 5 is a diagram showing a tray-selection screen.

When copy size button 24 is pressed on the initial screen in FIG. 2, tray-selection screen in FIG. 5 is displayed.

The tray-selection screen in FIG. 5 indicates thereon an illustration of an entire copying machine including a plurality of sheet-feeding trays arranged therein, and a selection is made by touching one of buttons 51–55 on the illustration representing sheet-feeding trays. A sheet size (in inch in the present example) is indicated on each of buttons 51–55 representing sheet-feeding trays, and a color sheet (COL.) and a recycled sheet (RCY.) are also indicated thereon as occasion demands.

With regard to setting of a kind of a sheet, a method for selecting and setting in a screen may also be employed in addition to an automatic detection by means of a color paper detection sensor.

Therefore, the copy sheet to be used can be selected for setting in the classification of a sheet-feeding tray by touching one of displayed buttons 51–55, and a display of the button selected is reversed.

As stated above, sheet-feeding trays displayed on the screen can be selected directly, and kinds of sheets as well as a sheet size are displayed. It is therefore possible to discriminate even when different sheets having the same sheet size are loaded.

In addition, when APS button 56 is pressed, a mode returns to an automatic paper selection mode.

When completing setting, OK button 57 is to be pressed and when canceling setting on the half way, cancel button 58 is to be pressed. Either of these occasions causes a screen to return to basic screen (shown in FIG. 4) mentioned above. Incidentally, even on the basic screen, selected sheet size and sheet type are displayed so that a user may recognize what has been selected.

In the present example, a user can recognize the type of set sheets in the classification of a sheet-feeding tray at a glance on an illustration, and a sheet-feeding tray can be selected directly. Therefore, not only a sheet size but also a sheet type can be selected, which is an advantage.

As stated above, the state of automatic setting and buttons to be used for transferring to manual setting are displayed on the initial screen, and after buttons on the initial screen are touched, screens of manual setting (a magnification-selection screen, a basic screen and a tray-selection screen) are displayed.

Further, when copy button 2 (shown in FIG. 1) is pressed for the start of copying, the initial screen (full-automatic screen) in FIG. 2 is transferred automatically to the basic screen in FIG. 4 which is a manual setting screen, and values determined by automatic selection mechanisms such as automatic density adjustment (AES) and automatic paper selection (APS) are displayed on the screen. Owing to this, a user can recognize the set values for the present copying.

After the completion of copying, a screen returns automatically to the initial screen in FIG. 2 so that the following operation may not be interrupted.

Incidentally, it is preferable that the selected button (function) is reversed in terms of color so that a user can recognize, and an operation sound by means of a buzzer is generated when a button is operated.

A button (function) which cannot be selected on the screen is made to be halftone so that it may not be selected.

Further, an arrangement is made so that no detection may be made even when a touch-panel having no pattern of button within LCD screen is pressed.

When two or more keys having different patterns respectively on the touch-panel are pressed simultaneously, it is treated to be invalid.

Further, as shown in FIGS. 1–5, a help button having thereon a "?" mark is provided on each screen (or provided at a place outside the screen), and when the button is pressed, a display corresponding thereto appears on the screen. When the help button is operated, there are displayed illustrations and messages which show how to use a copying machine (explanation on how to clear jam, how to replenish toner, how to load copy sheets and various functions).

In the invention, as stated above, when displaying a setting screen on a screen that serves also as a touch-panel provided on a copying machine as an operation panel for inputting, the state of automatic setting as well as buttons for switching to manual setting are displayed on the screen in the initial state, and after touching the button on the initial screen, a screen for manual setting is displayed. Therefore, a screen is simple and easy to observe in the initial state, and when setting manually, a necessary screen appears to enable an user to set in detail, which is an advantage.

Further, in the course of copying, an user can make sure various values of automatic setting owing to the display of a manual setting screen, and concurrently with the completion of copying, the screen automatically returns to the initial screen, which does not adversely affect an easy operation.

Next, examples achieving the third object of the invention will be explained as follows.

When automatic mode button 10 located outside the frame of LCD screen 1 in FIG. 1 is pressed, various settings including a copy mode are initialized and the LCD screen 1 returns to the initial screen (full-automatic mode screen) shown in FIG. 2.

Figure 6:
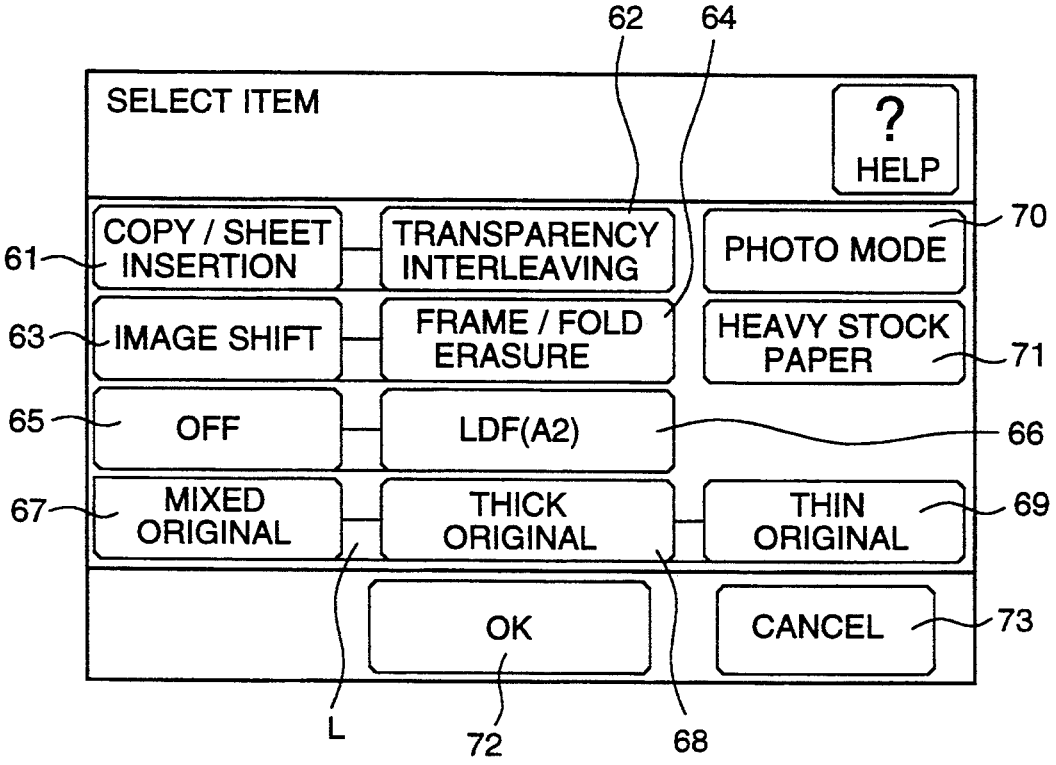
FIG. 6 is a diagram showing an applied-selection screen.

When application button 11 located outside the frame of LDC screen in FIG. 1 is pressed (provided that the LCD screen is in the state of a basic screen), the LCD screen is changed to an applied-selection screen shown in FIG. 6. On the applied-selection screen, it is possible to set ON-OFF functions of various types and to transfer to a screen for setting, and the display of the function set is reversed.

On the applied-selection screen in FIG. 6, buttons for functions which can not coexist are displayed to be related to each other.

The numeral 61 is an inter-sheet-selection button which is in charge of a transfer to an inter-sheet-setting screen through an operation of which a colored sheet or a white sheet can be inserted as it is or after being subjected to copying as a cover sheet or an insert to be inserted somewhere midway in a plurality of copies. The numeral 62 is an OHP-sheet-insert-selection button which is in charge of a transfer to an OHP-sheet-insert-setting screen that is for setting a sheet to be inserted between OHP-sheets when copying on an OHP-sheet. These buttons 61 and 62 are exclusive inputting buttons and they are arranged transversely and are connected by connecting line L so that they may be related to each other.

The numeral 63 is a selection button for the setting of a binding margin and it is in charge of a transfer to a binding-margin-setting screen with which a binding margin can be provided on the right-hand side or left-hand side of a copy. The numeral 64 is a selection button for setting of frame-elimination/fold-elimination, and it is in charge of a transfer to a frame-elimination/-fold-elimination setting screen for eliminating shade on the periphery of a copy sheet or shade on the central portion of a copy sheet in book copying. These buttons 63 and 64 are exclusive inputting buttons and they are arranged transversely and are connected by connecting line L so that they may be related to each other.

The numeral 65 is a CFF mode setting button, and it selects or cancels the CFF mode. The numeral 66 is an LDF (A2) mode setting button, and it selects or cancels the LDF (A2) mode. These buttons 65 and 66 are exclusive inputting buttons and they are arranged transversely and are connected by connecting line L so that they may be related to each other.

The numeral 67 is a setting button for mixed-document mode, and it selects or cancels a mixed-document mode. The numeral 68 is a setting button for a thinner document mode, and it selects or cancels a thinner document mode. The numeral 69 is a setting button for a thicker document mode, and it selects or cancels a thicker document mode. These buttons 67–69 are exclusive inputting buttons and they are arranged transversely and are connected by connecting line L so that they may be related to each other.

The numeral 70 is a photograph-mode-setting button and it selects or cancels a photograph mode. Since this button 70 is not an exclusive inputting button, it is displayed independently.

The numeral 71 is a thicker sheet mode setting button, and it selects or cancels a thicken sheet mode. Since this button 70 is not an exclusive inputting button, it is displayed independently.

When completing setting, OK button 72 is to be pressed, while when canceling setting on the half way, cancel button 73 is to be pressed. In these cases, a screen returns to the basic screen (shown in FIG. 4).

As stated above, buttons having functions which can not coexist on the screen are displayed to be related to each other, which results in an operation that is understood easily.

Incidentally, when job button 12 located outside the frame of LCD screen 1 in FIG. 1 is pressed, the LCD screen 1 is changed to an unillustrated job-selection screen in terms of screen display. Explanation of the job-selection screen, however, will be omitted.

Further, when copy button 2 (shown in FIG. 1) is pressed for the start of copying, the initial screen (full-automatic screen) in FIG. 2 is transferred automatically to the basic screen in FIG. 4 which is a manual setting screen, and values determined by automatic selection mechanisms such as automatic density adjustment (AES) and automatic paper selection (APS) are displayed on the screen. Owing to this, a user can recognize the set values for the present copying.

After the completion of copying, a screen returns automatically to the initial screen in FIG. 2 so that the following operation may not be interrupted.

In the invention, as stated above, exclusive inputting buttons are grouped and displayed to be related to each other, which offers an advantage that an operation is easy to understand and easy to perform.

Examples achieving the fourth and fifth objects of the invention will be explained as follows, referring to the drawings.

Figure 7:
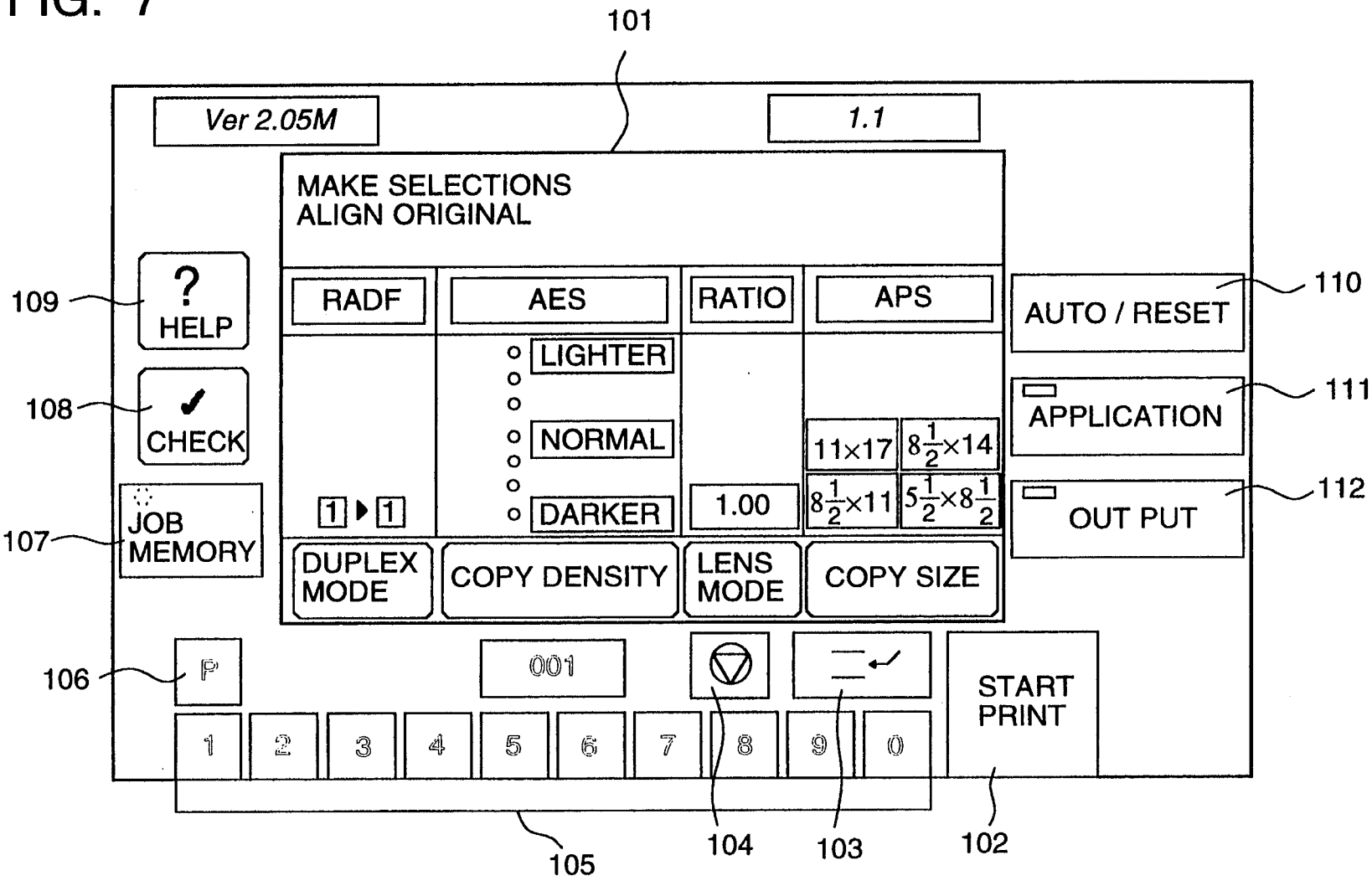
FIG. 7 is a general view of an operation panel showing an example of the invention.

FIG. 7 shows an entire operation panel of a copying machine, and almost at the center thereof, there is provided LCD screen (liquid crystal display screen) 101 that serves also as a touch-panel.

Various buttons are arranged around the LCD 101. The numeral 102 is a copy button which is used for execution of copying, and 103 is an interruption button which is used for urgent copying that interrupts regular copying. The numeral 104 is a stop/clear key which is used for suspension of copying work or for resetting of the number of copies. The numeral 105 is a ten-key to be used for setting quantity of copies, and 106 is a P-button that is used for specific operation. The numeral 107 is a JOB button which is used when the conditions of copying operation (copying conditions) set manually are stored in the machine. The numeral 108 is a check button which is used when the conditions of copying operation (copying conditions) set manually are displayed in a table for confirmation. The numeral 109 is a HELP button and it is used when displaying a screen of operation explanation in the screen which appears when this button is pressed. An AUTO/RESET button is represented by 110 and it initializes various settings including a copy mode. An APPLICATION button is represented by 111 and it transfers to an applied-selection screen. The numeral 112 is an OUT PUT button and it is used when setting how the copied sheet should be ejected (post processing for the copied sheet).

Contents of LCD screen 101 will be explained as follows.

Figure 8:
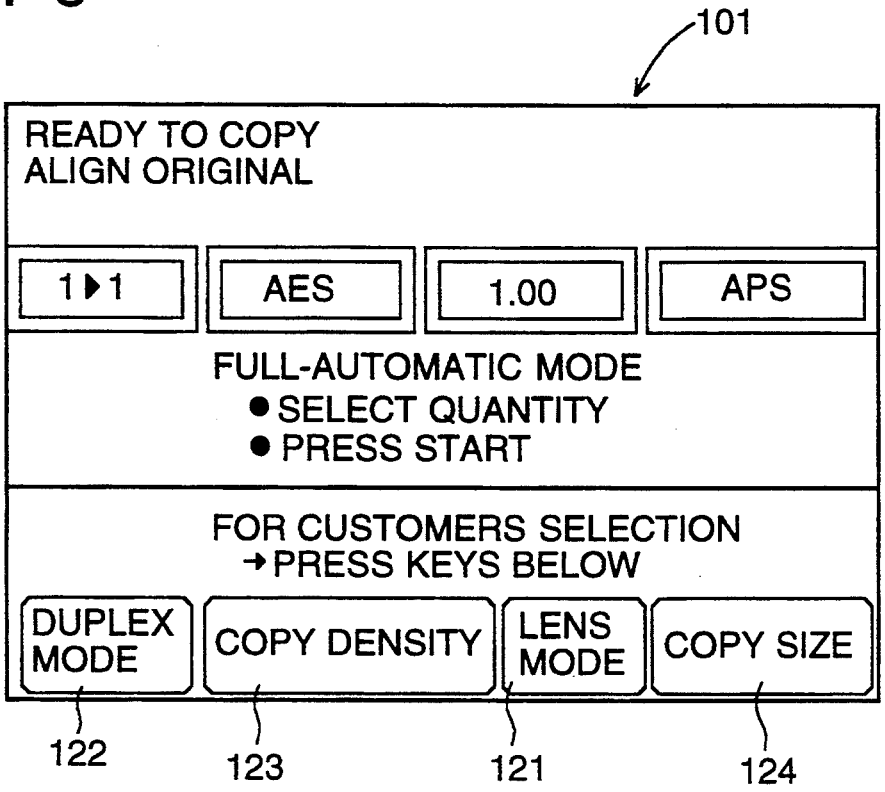
FIG. 8 is a diagram showing the initial screen.

Upon completion of warm-up after the power source is turned on, a copying machine is caused to be on a full-automatic mode, and an initial screen shown in FIG. 8 appears on the LCD screen 101. Incidentally, FIG. 8 shows only LCD screen 101 among those shown in FIG. 7. It is recommendable that contrast and back light of the LCD screen 101 can be adjusted on an operation panel.

An initial screen in FIG. 8 represents a full-automatic screen which shows that magnification of one time (1.00), one side → one side copying (1→1), automatic density adjustment (AES), automatic paper selection (APS) have been set automatically (full automatic mode).

Further, four buttons 121–124 for transferring to manual setting are displayed on the lowermost step. The numeral 121 represents a lens mode button, 122 is a duplex mode button, 123 is a copy density button and 124 is a copy size button.

On the message area at the uppermost step, there are displayed the state of the copying machine and a message showing operation procedures to an operator.

When any button among lens mode button 121, duplex mode button 122, copy density button 123 and copy size button 124 is touched on the initial screen (full automatic mode) shown in FIG. 8, the screen is changed to one for setting the corresponding copying condition. Then, when an OK button or a cancel button displayed on the manual setting screen is touched, the screen returns to the basic screen shown in FIG. 9.

Figure 9:
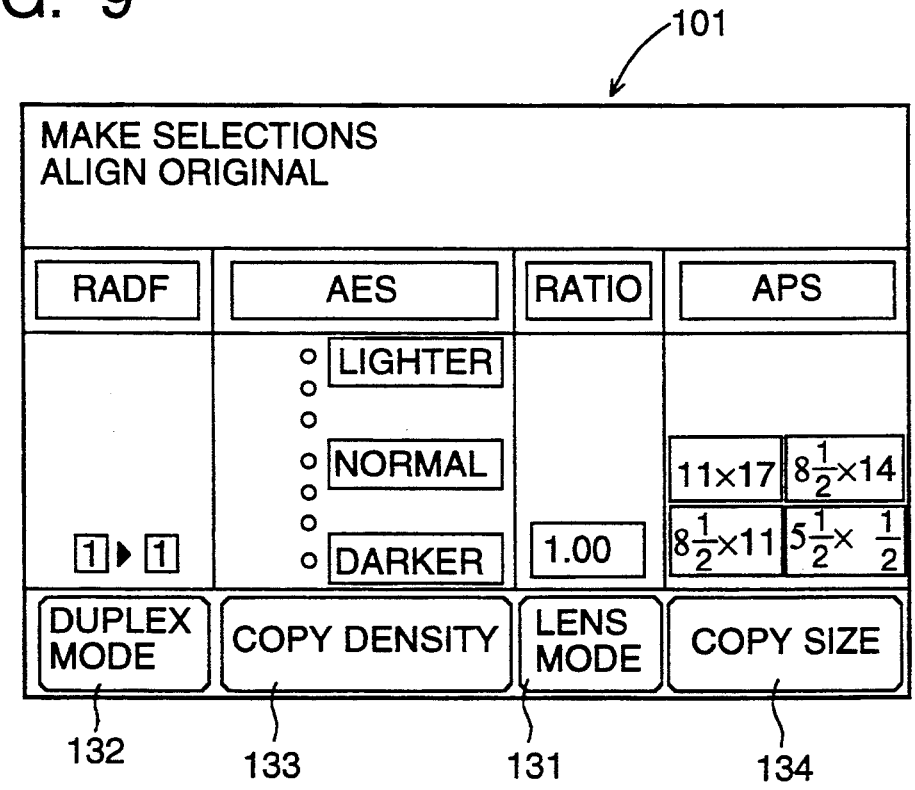
FIG. 9 is a diagram showing a basic screen.

On the basic screen shown in FIG. 9, there are displayed lens mode button 131, duplex mode button 132, copy density button 133 and copy size button 134, similarly to the initial screen mentioned above, and when any of these buttons is touched, the screen is changed to one exactly the same as the screen which appears when the button of the same function on the initial screen is touched.

On the basic screen, there are further displayed the set conditions such as magnification, copy mode, density adjustment and copy size which correspond respectively to the above-mentioned lens mode button 131, duplex mode button 132, copy density button 133 and copy size button 134.

Figure 10:
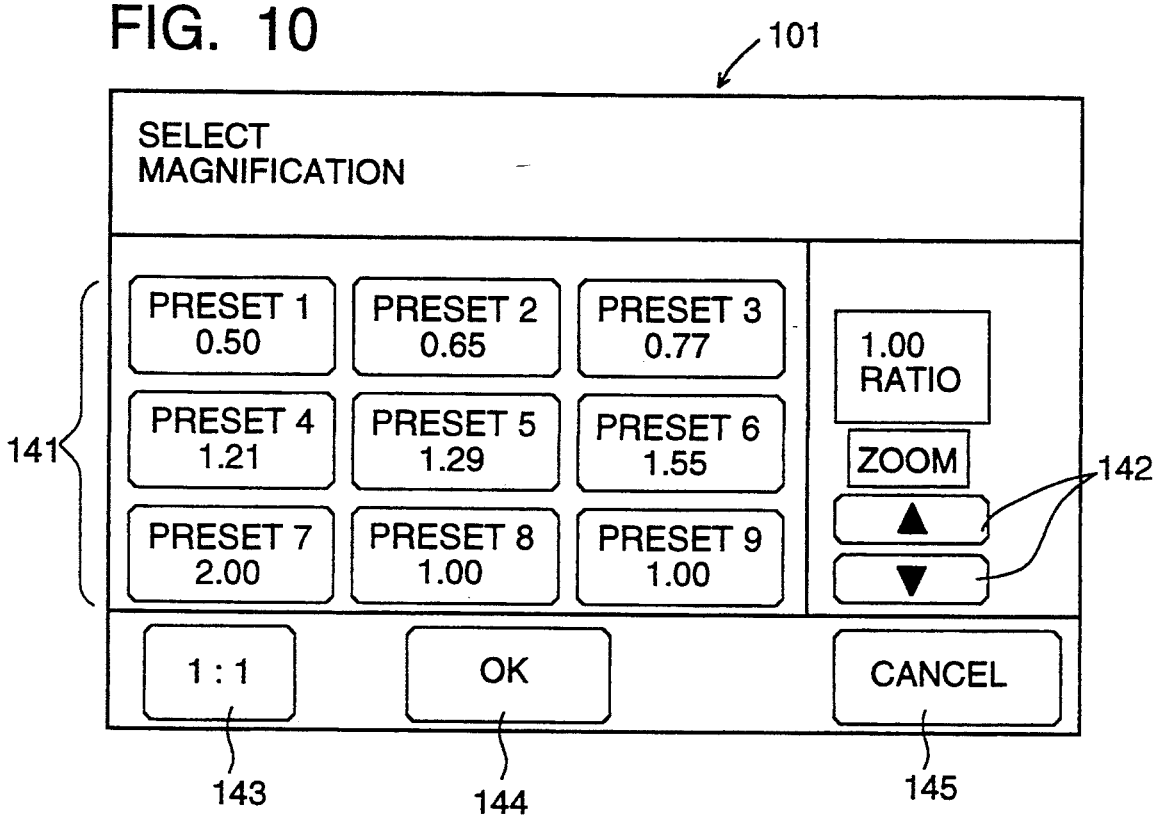
FIG. 10 is a diagram showing a magnification-setting screen.

When lens mode button 121 on an initial screen or lens mode button 131 on a basic screen is operated, a magnification-selection screen shown in FIG. 10 is displayed on LCD screen 101. On the magnification-selection screen in FIG. 10, selection buttons 141 for various fixed magnifications are displayed. Therefore, it is possible to set the magnification manually by selecting the desired magnification or the magnification close to that desired magnification from displayed magnifications and touching it. Further, when it is necessary to adjust to the magnification other than the aforementioned fixed magnification, it is possible to select the desired magnification freely within specified magnifications by means of up/down button 142. When setting to the magnification of one time, on the other hand, 1:1 button 143 is to be touched.

When completing magnification setting, OK button 144 is to be touched, while, when canceling setting, CANCEL button 145 is to be touched. When the OK button 144 or the CANCEL button 145 is touched, a screen returns to the basic screen in FIG. 9 in either case.

Further, when duplex mode button 122 on an initial screen or duplex mode button 132 on a basic screen is touched, a copy-mode-setting screen in FIG. 5.is displayed on LCD screen 101.

Figure 11:
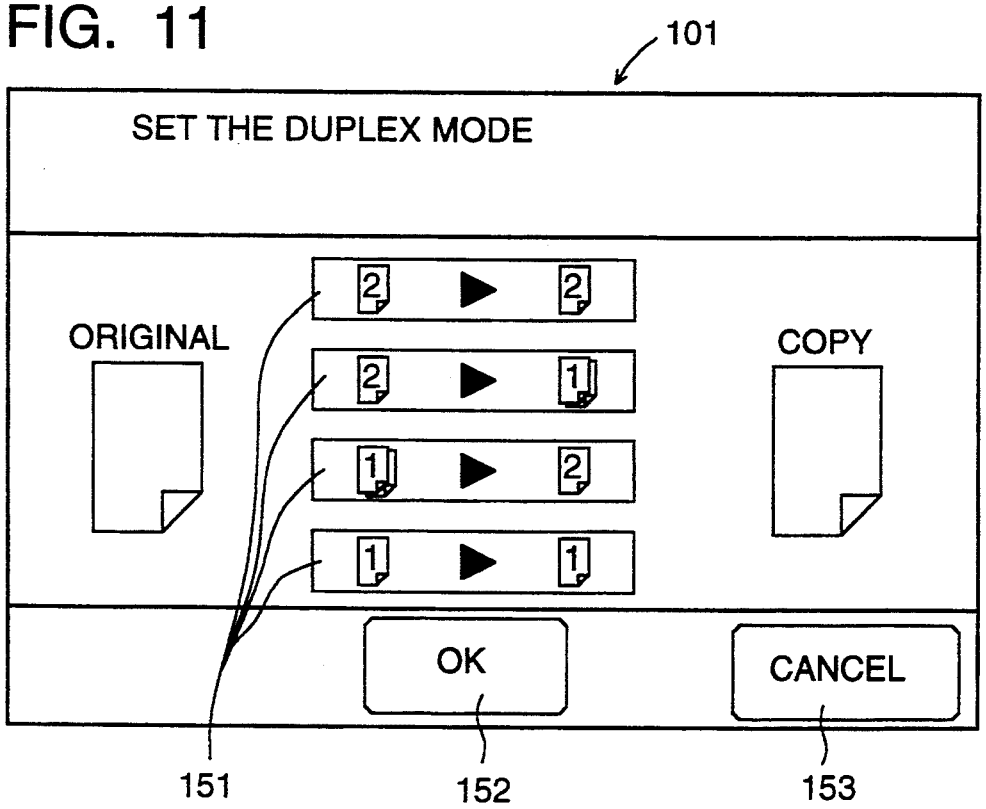
FIG. 11 is a diagram showing a copy-mode-setting screen.

On a copy-mode-setting screen in FIG. 11, there are displayed copy-mode-selecting buttons 151 corresponding respectively to four copy modes, namely, one side → one side (1→1), one side → duplex (1→2), duplex → one side (2→1), duplex → duplex (2→2). From these buttons, appropriate mode button 151 is touched for manual setting thereof. On the lowermost step of the copy-mode-setting screen, too, OK button 152 and CANCEL button 153 are displayed, and when completing mode setting, OK button 152 is to be touched and when canceling the setting on the half way, CANCEL button 153 is to be touched. When the OK button 152 or the CANCEL button 153 is touched, a screen returns to the basic screen shown in FIG. 9 in either case.

Figure 12:
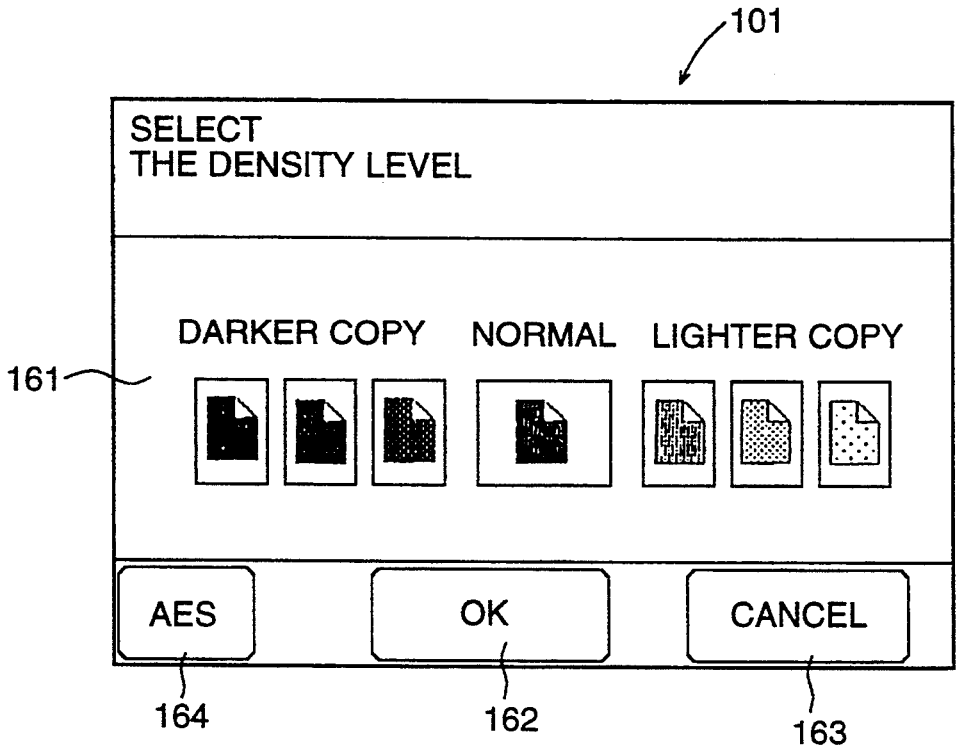
FIG. 12 is a diagram showing a density-setting screen.

When copy density button 123 on the initial screen or copy density button 133 on the basic screen is touched, a density adjustment screen shown in FIG. 12 is displayed on LCD screen 101.

On the density adjustment screen shown in FIG. 12, there are displayed buttons 161 for selecting appropriate density from seven copy density levels, and it is possible to select given density through the button 161. On the lowermost step of the density adjustment screen, there are displayed AES button 164 as well as OK button 162 and CANCEL button 163, and it is also possible to return to an automatic adjustment mode by touching the AES button 164.

Figure 13:
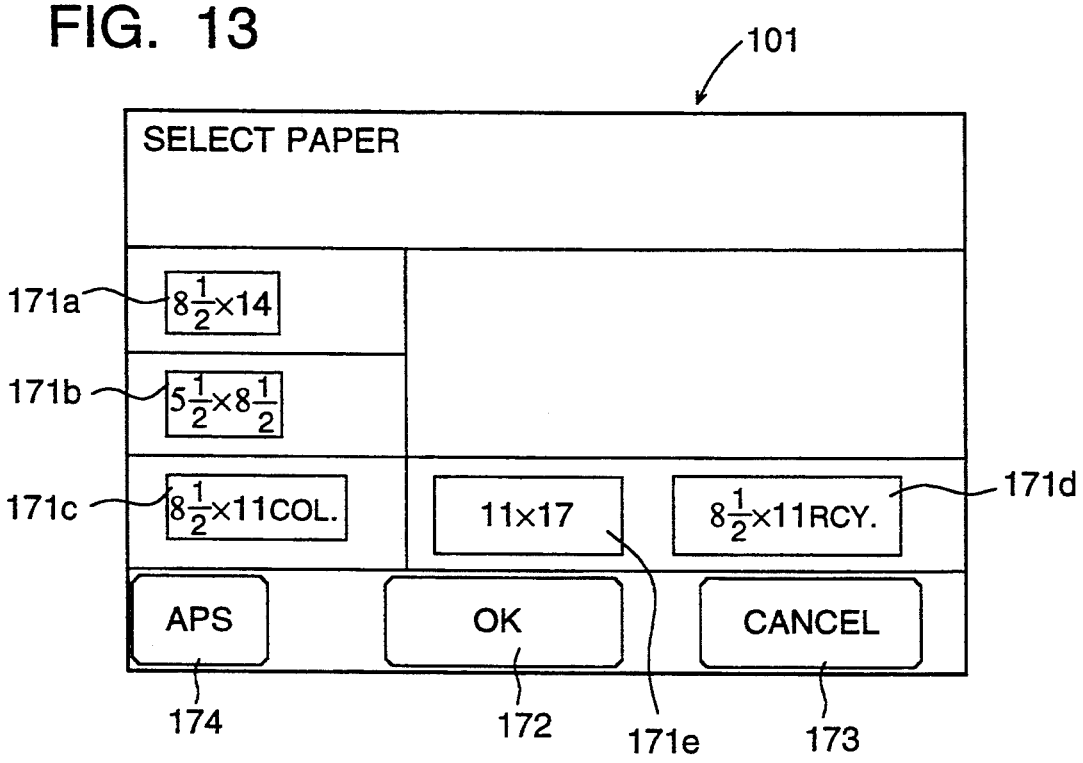
FIG. 13 is a diagram showing a copy-size-setting screen.

Further, copy size button 124 on the initial screen or copy size button 134 on the basic screen is touched, copy-sheet-selection screen shown in FIG. 13 is displayed on LCD screen 101.

On the copy-sheet-selection screen in FIG. 13, there is indicated an illustration of the whole copying machine including an arrangement of a plurality of sheet-feeding trays, and there are further displayed buttons **171*a*–171*e* representing the sheet-feeding trays in the illustration. On the buttons 171*a*–171*e* representing the sheet-feeding trays, there are indicated sheet sizes (sizes in inch in the example shown in FIG. 13), and when necessary, colored sheet (COL.) and recycled sheet (RCY.) are also displayed. On the lowermost step on the copy-sheet-selection screen, there are displayed APS button 174, OK button 172 and CANCEL button 173, and when the APS button 174** is touched, it is possible also to return to an automatic sheet select mode.

When magnification, copy mode, copy density and copy sheet are set manually as stated above and then a screen returns to the basic screen shown in FIG. 9, conditions manually set are indicated corresponding respectively to lens mode button 131, duplex mode button 132, copy density button 133 and copy size button 134, thus the state of manual setting can be confirmed.

Next, how to set manually methods of ejection of copied sheet (post processing for copied sheet such as sorting, stapling and reversed ejecting) will be explained as follows.

Figure 14:
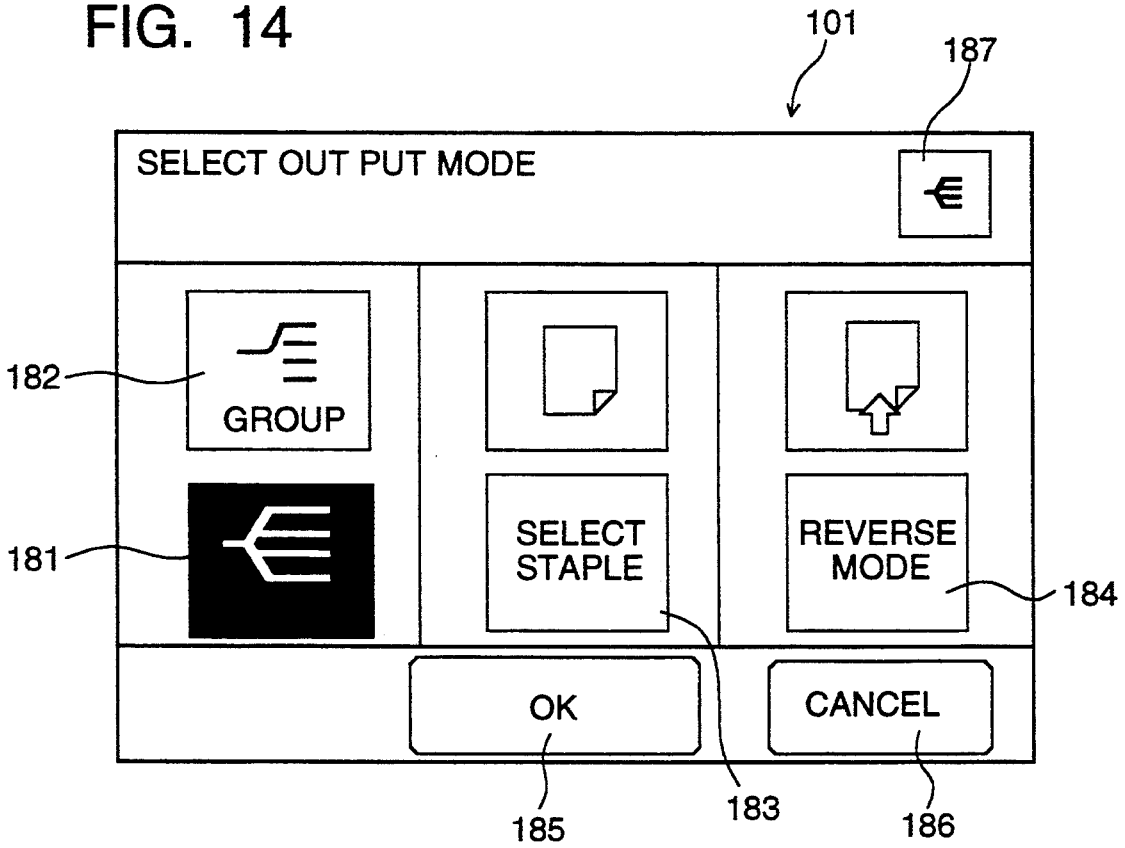
FIG. 14 is a diagram showing a post-processing-setting screen.

There is provided OUT PUT button 112 that is used for setting manually the above-mentioned sheet-ejection method outside LCD screen 101 as stated above, and when the OUT PUT button 112 is pressed, any setting screen then displayed is switched to a SELECT OUT PUT screen shown in FIG. 14 and displayed on LCD screen 101.

On the SELECT OUT PUT screen shown in FIG. 14, there are displayed sort mode button 181 which selects a sort mode, group mode button 182 for selecting a group mode, staple-selecting button 183 for selecting the use of stapler, reverse mode button 184 for selecting reversed sheet-ejection, OK button 185 and CANCEL button 186.

In the sorter selection mentioned above, a sort mode is selected as an initial value, and the state wherein the sort mode is selected is shown by the black-background display of a sort-mode-showing mark on the sort mode button 181. In this case, when group mode button 182 is touched, a group mode is selected to replace the sort mode. Thereby, the sort-mode-showing mark on the sort mode button 181 is reversed to appear as a white-background display that represents non-selected state, while a group-mode-showing mark on group mode button 182 is reversed to appear as a black-background display that represents the selected state.

When a button on the selected side shown by the black-background display among the above-mentioned sort mode button 181 and group mode button 182 is touched, the state results in one wherein neither a sort mode nor a group mode is selected, thus copied sheets are ejected onto the uppermost bin.

When SELECT STAPLE button 183 is touched, a mode to use staples is selected and the results of the selection is shown by the reversed display of the SELECT STAPLE button 183. Incidentally, when canceling the use of staples, the select staple button 183 may be touched again.

Further, when reverse mode button 184 is touched, a mode is changed to one wherein a copy sheet is reversed and ejected, and the results of the selection of the reverse mode is indicated by the reversed display of the reverse mode button 184.

Even in this case, when canceling the mode for reversing and ejecting a sheet, the reverse mode button 184 is to be touched again.

It is so arranged that an illustration showing a staple, or an illustration showing a copied side is displayed on a copy sheet-illustration indicated above the button 183, or on a copy sheet-illustration indicated above the button 184, when the aforementioned use of staples or sheet-ejection after reversing is selected.

On a message area at the uppermost step of the SELECT OUT PUT screen, there is indicated an indicator mark showing conditions for the settled use of sorter and staples. In the case of the first access to the SELECT OUT PUT screen, a sort mode is selected as an initial value. Therefore, indicator mark 187 showing the aforementioned sort mode is indicated. In this case, even when SORT is switched to GROUP on the SELECT OUT PUT screen shown in FIG. 14 or even when the use of staples is selected, they are not settled until OK button 185 is touched. Therefore, the above-mentioned indicator mark is not changed by the selecting operation.

When setting for how to eject sheets (post processing) has been completed in the way stated above, OK button 185 is touched and when canceling the setting on the half way, CANCEL button 186 is touched. When either the OK button 185 or the CANCEL button 186 is touched, a screen returns to a basic screen on which the aforementioned indicator marks showing the state of the selection of sorter and staple are indicated at the message area as shown in FIG. 15.

Figure 15:
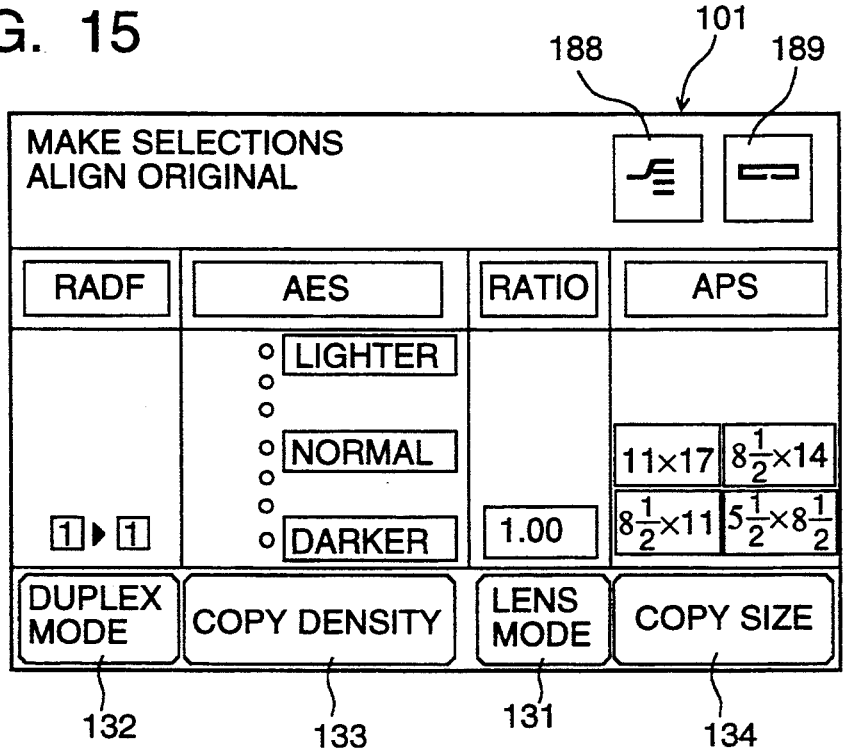
FIG. 15 is a diagram showing examples of indicator mark display of post processing conditions in the basic screen.

The illustration represented by FIG. 15 shows the state that a group mode is selected and the use of staples is further selected, For example, even when setting manually the group mode and the use of staples on the SELECT OUT PUT screen shown in FIG. 14, an indicator mark on a message area is only for sort mode representing an initial value. In this case, however, when the group mode and the use of staples are settled by touching the OK button 185, indicator marks 188 and 189 showing respectively the group mode and the use of staples are indicated on a message area of a basic screen as shown in FIG. 15, responding to the above settlement.

Further, even when the basic screen is changed to the other setting screen, the indicator marks mentioned above continue to be indicated on a message area similarly to the occasion of the basic screen as shown in FIG. 15 so that the state of setting for the post processing may be confirmed on any setting screen.

For the purpose of confirming the state of setting how to eject sheets (the post processing), therefore, an access to a SELECT OUT PUT screen shown in FIG. 14 is not necessary and contents of indication on the other setting screen are not restricted because a small indicator mark indicates the state of setting. In addition, compared with an occasion wherein selection buttons corresponding respectively to sorter, staple and reverse/ejection are provided separately outside LCD screen 101, it is possible to reduce the number of buttons located outside LCD screen 101 and to simplify the arrangement of an operation panel even when multiple functions are incorporated.

Figure 16:
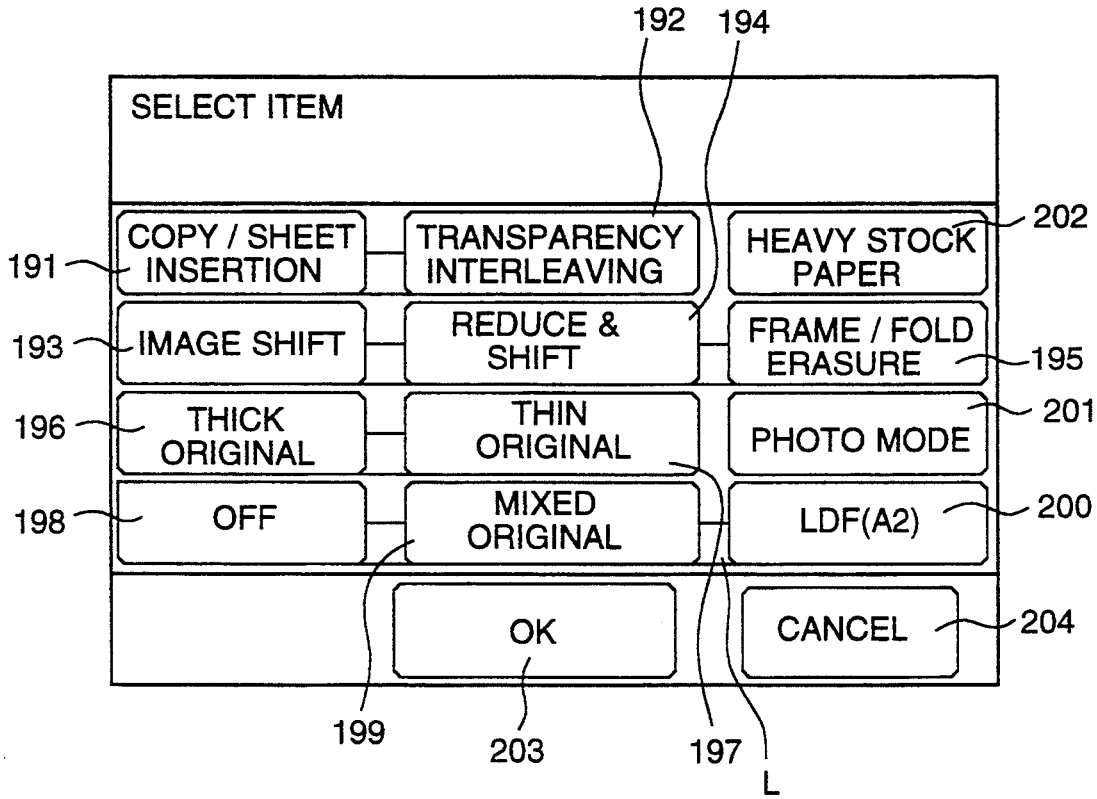
FIG. 16 is a diagram showing an applied-selection screen.

Further, when application button 111 is pressed under the condition that a basic screen is indicated, a display screen on the LCD screen 101 is changed to an applied selection screen shown in FIG. 16.

Incidentally, on the applied selection screen in FIG. 16, buttons which can not coexist in terms of function are indicated to be related to each other.

The numeral 191 is an inter sheet-selection button which switches to an inter-sheet-setting screen through an operation of which a colored sheet or a white sheet can be inserted as it is or after being subjected to copying as a cover sheet or an insert to be inserted somewhere midway in a plurality of copies. The numeral 192 is an OHP-insert-selection button which is in charge of a transfer to an OHP-insert-setting screen which is for setting a sheet to be inserted between OHPs when copying on an OHP. These buttons 191 and 192 are exclusive inputting buttons and they are arranged transversely and are connected by connecting line L so that they may be related to each other.

The numeral 193 is a selection button for the setting of a binding margin and it is in charge of a transfer to a binding-margin-setting screen with which a binding margin can be provided on the right-hand side or left-hand side of a copy. The numeral 194 is a reduction shift setting selection button and it switches to a reduction shift screen for providing a binding margin on a copy sheet and copying all items described on a document surface by setting the reduction shift. The numeral 195 is a selection button for setting of frame-elimination/-fold-elimination, and it is in charge of a switchover to a frame-elimination/fold-elimination setting screen for eliminating shade on the periphery of a copy sheet or shade on the central portion of a copy sheet in book copying. These buttons 193, 194 and 195 are exclusive inputting buttons and they are arranged transversely and are connected by connecting line L so that they may be related to each other.

The numeral 196 is a setting button for a thicker document mode, and it selects or cancels a thicker document mode. The numeral 197 is a setting button for a thinner document mode, and it selects or cancels a thinner document mode. These buttons 196 and 197 are exclusive inputting buttons and they are arranged transversely and are connected by connecting line L so that they may be related to each other.

The numeral 198 is a setting button for CFF mode, and it selects and cancels a mode (DFF mode) wherein a document is a continuous folded sheet provided with perforations which is used for computer output. The numeral 199 is a setting button for a mixed-document mode, and it selects and cancels a mixed-document mode. Further, 200 is a setting button for an LDF mode, and it selects and cancels a mode (LDF mode) wherein a large-sized document such as an A2 size document or the like is copied. These buttons 198, 199 and 200 are exclusive inputting buttons and they are arranged transversely and are connected by connecting line L so that they may be related to each other.

Further, 201 is a photograph copy mode, and it selects and cancels a photograph copy mode, while 202 is a setting button for a thicker sheet copy mode, and it selects and cancels a mode for copying on a thicker sheet.

When a screen has been changed from the aforementioned applied selection screen in FIG. 10 to a further lower setting screen, the screen returns, after the completion of setting, to the applied selection screen again where, when OK button 203 or CANCEL button 204 is touched, the screen returns to the basic screen.

On the basic screen, there are indicated the state of setting of conditions such as magnification, copy mode, copy density and copy sheet which are manually set relatively frequently as well as buttons 131–134 for switching to setting screens respectively for various conditions. With regard to the post processing for a copy sheet such as sorting or the like, it is indicated as an indicator mark on the basic screen.

Therefore, with regard to magnification, copy mode, copy density copy sheet and post processing (sorter and staple), it is possible to confirm their setting on the basic screen. However, with regard to the conditions which are set on the aforementioned applied selection screen and are set manually relatively rarely, they are not indicated on the basic screen. If all conditions to be set on the above-mentioned applied selection screen are indicated on the basic screen in an arrangement, it would be unavoidable that contents to be indicated on the basic screen are complicated.

In the present example, therefore, the check button 108 mentioned above is provided outside the screen so that conditions set may easily be confirmed when the conditions are set manually on the applied selection screen. When the check button 108 is pressed, any screen indicated on that occasion can be changed to a screen showing a table of set conditions as shown in FIG. 17, and when OK button 209 is touched after confirmation, the screen returns to the previous setting screen again, in the arrangement.

Figure 17:
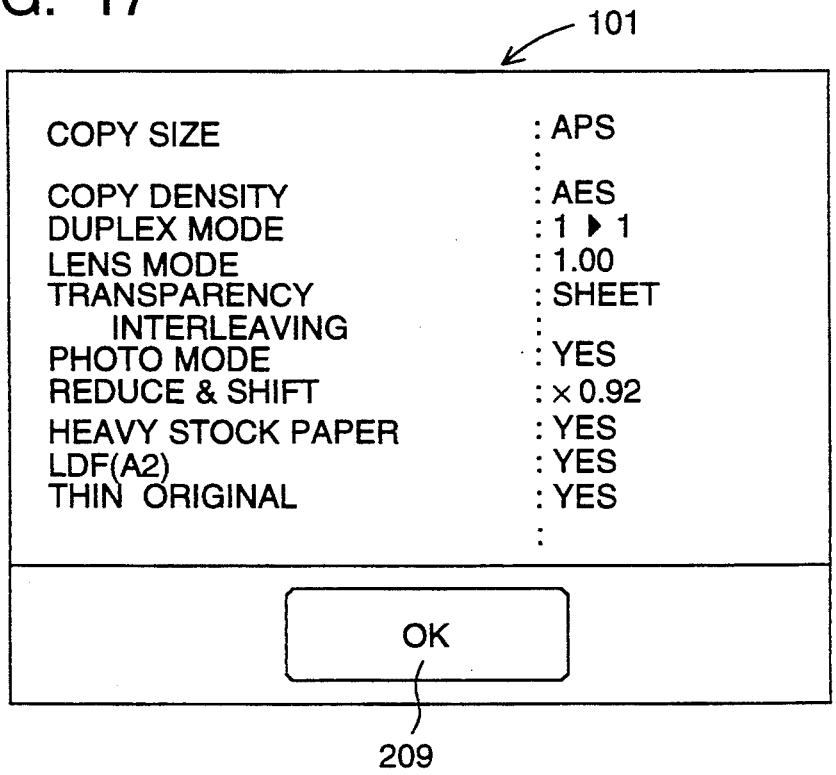
FIG. 17 is a diagram showing a check screen.

On the check screen in FIG. 17, names of the conditions set on the applied selection screen are indicated on the column at the left-hand side of the check screen in addition to the conditions indicated on the basic screen. On the column separated by a dotted line at the left-hand side thereof, on the other hand, there is indicated a display showing the state of setting of the conditions mentioned above. In the example shown in FIG. 17, for example, there are set various conditions including automatic sheet selection, automatic density-adjustment, one side → one side copying, the magnification of one time, OHP interleaved with a white sheet, photograph copy, setting of binding margin by means of reduction and shift, copying on a thicker sheet, copying of large-sized document and a thinner document.

When the conditions set on the applied selection screen as well as those which can be confirmed on the basic screen are indicated in a table as stated above, all conditions can be confirmed only on the check screen when various conditions are set on the applied selection screen, thus conditions can be confirmed easily when various conditions are set manually.

When various conditions including those set on the applied selection screen as stated above are set manually, and when a pattern of such conditions is frequently used for copying, it is preferable that the pattern of the conditions mentioned above is stored in a copying machine for automatic condition-setting after an access to the registered pattern, rather than setting manually each time from the initial state. Therefore, the copying machine in the present example is provided with a structure which holds a pattern of conditions which may be registered or may be subjected to access as follows.

Figure 18:
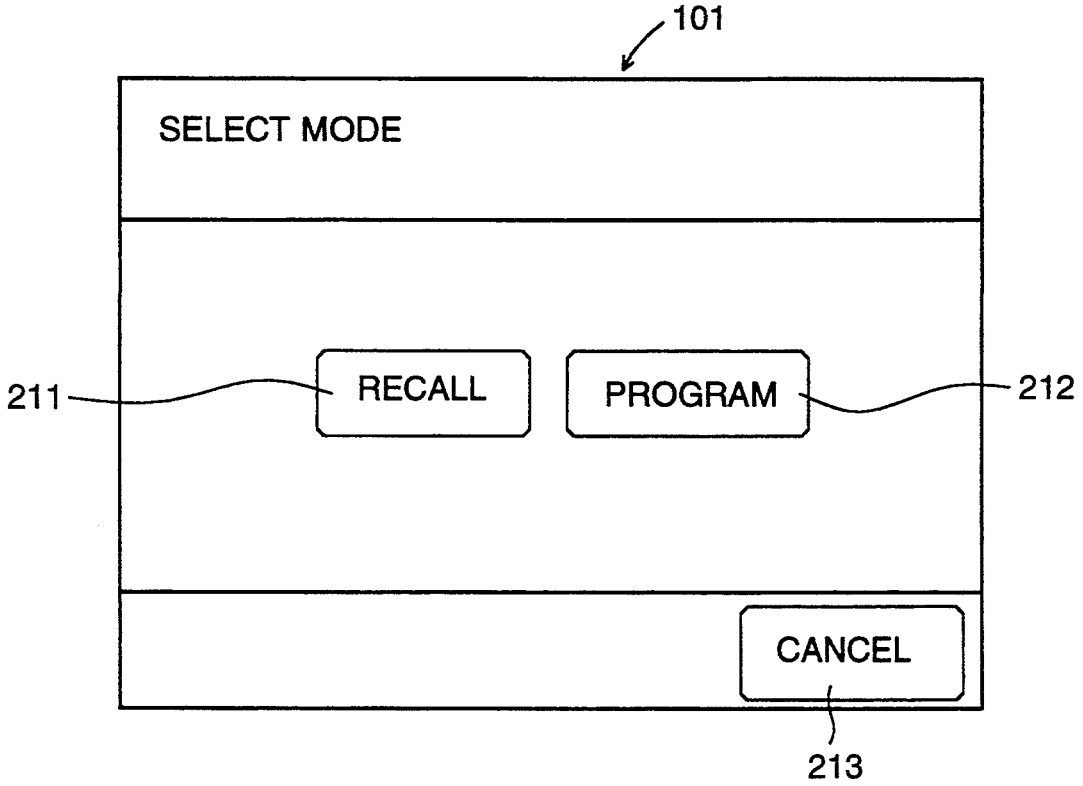
FIG. 18 is a diagram showing a JOB-function-selection screen.

First, when registering the patterns set manually, JOB button 7 is required to be pressed so that a JOB function selection screen shown in FIG. 18 may be indicated.

On the JOB function selection screen shown in FIG. 18, there are displayed recall button 211 used for the access to the registered condition pattern, program button 212 for registering newly and CANCEL button 213 for canceling JOB function selection.

For registering newly, in this case, the program button 212 is touched. Then, a JOB No. selection screen shown in FIG. 19 is displayed.

Figure 19:
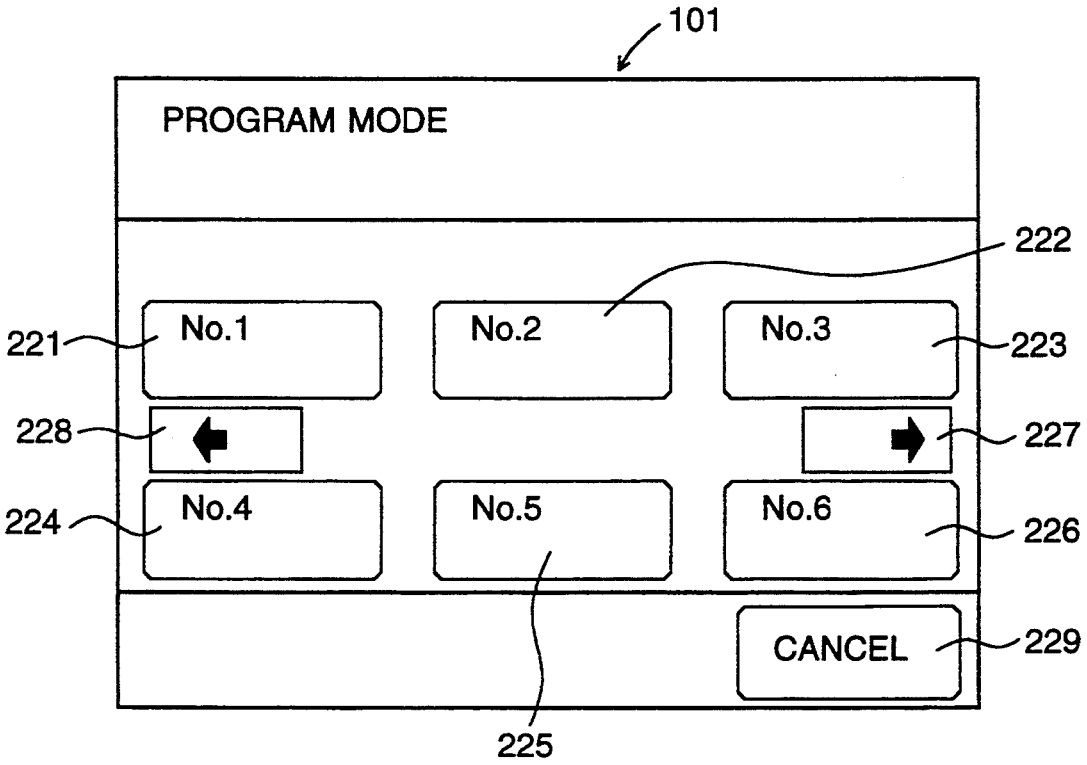
FIG. 19 is a diagram showing a JOB No.-selection screen.

In FIG. 19, only six registration area buttons 221–226 representing registration areas from No. 1 to No. 6 are displayed, and when advancing button 227 and returning button 228 each being marked with an arrow in FIG. 19 are touched, it is possible to indicate four kinds of screens including, in addition to the aforementioned screen showing registration areas from No. 1 to No. 6, a screen showing registration areas from No. 7 to No. 12, a screen showing registration areas from No. 13 to No. 18 and a screen showing registration areas from No.

19 to No. 24. Incidentally, when canceling registration job in the state wherein a selection screen is displayed, it is possible to return to a JOB function selection screen in FIG. 18 by touching CANCEL button 229.

An operation of touching a given registration area button among unregistered numbers in the group No. 1–NO. 24 of JOB No. selection screens mentioned above changes to the above-mentioned basic screen with which various conditions may be set manually.

Incidentally, whether a certain registration area has been registered or not can be judged based on whether a registration name that is inputted in the course of registration is described on the registration area button as stated later or not. With regard to an area registered without an inputted registration name, the registration name to be described therefor is "untitle". When a screen is returned to the basic screen after the designation of an area to be registered, it is recommended that the state of manual setting for registration is shown by the reversed "0" mark provided on JOB button 7, for example.

After various screens are called for access as described above, magnification, copy mode, copy density, copy sheet, post processing and further special conditions on an applied selection screen are set by an operation of touching a button displayed on the screen.

After completion of the setting, the JOB button 107 is pressed again. Then, a check screen that is mostly the same as one appears when the check button 108 is pressed is indicated as shown in FIG. 14, and conditions to be registered as well as conditions to be set by means of an applied selection screen are confirmed by the check screen mentioned above.

Figure 20:
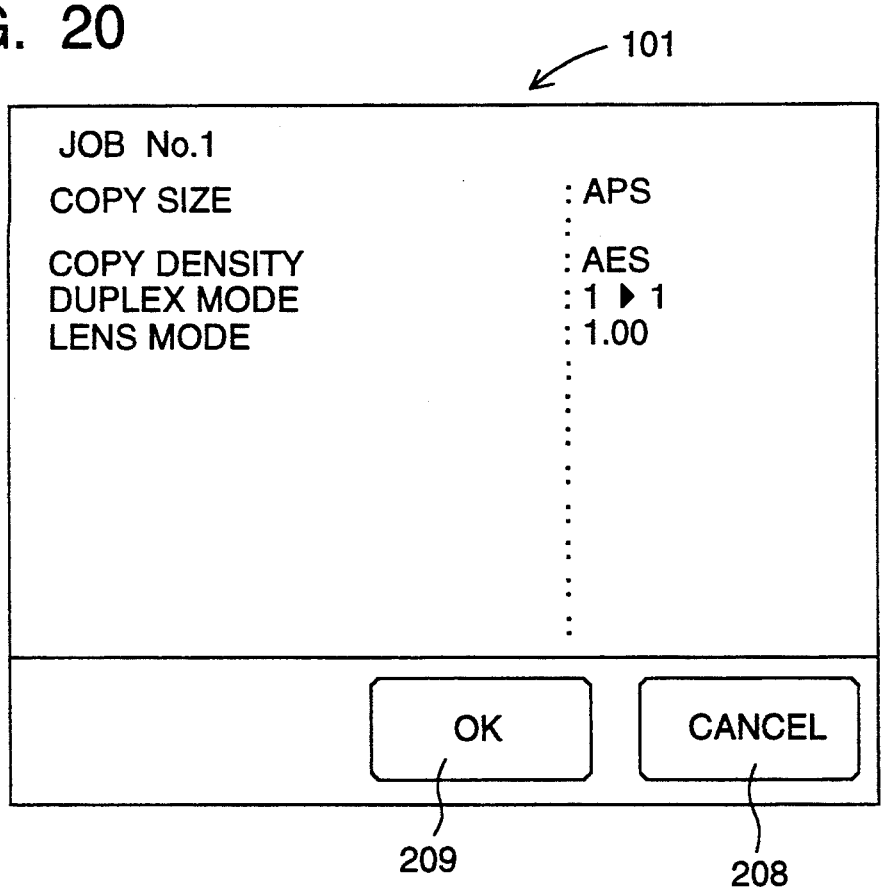
FIG. 20 is a diagram showing a check screen in the course of a registration work.

On the check screen in the course of the registration operation described above, a display showing the number of the area to be registered appears on the uppermost step as shown in FIG. 20. The example shown in FIG. 20 indicates that conditions shown in the area No. 1 are to be registered.

Incidentally, it may be also possible to start a registration operation after setting manually various conditions in advance.

When it is confirmed that there is no error on a condition-pattern to be registered on a check screen in FIG. 20, OK button 209 is to be touched, while, when an error is detected in the conditions-set, CANCEL button 208 is to be touched so that a mode may be returned to a condition-setting mode.

Figure 21:
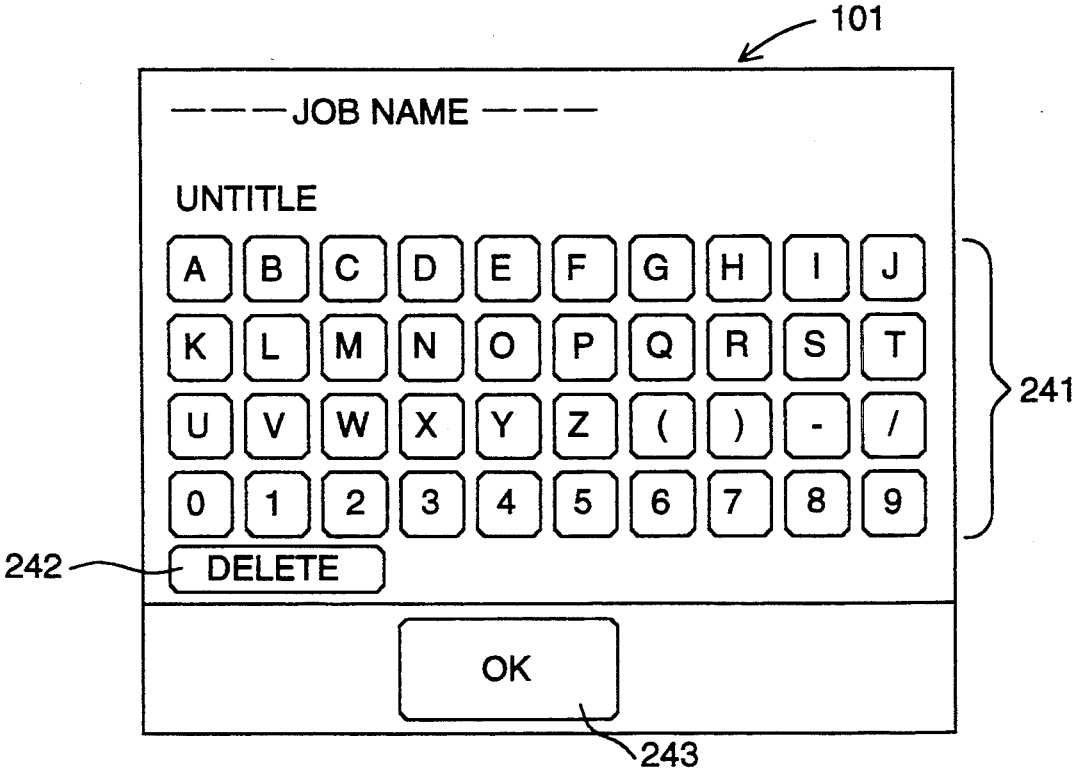
FIG. 21 is a diagram showing a JOB-name-registration screen.

When a condition pattern to be registered is confirmed and OK button 209 is touched on the check screen in FIG. 20, a JOB name registration screen shown in FIG. 21 through which registration names are inputted is displayed.

On the JOB name registration screen, there are displayed key board 241 consisting of alphabetical keys and numerical keys as well as DELETE button 242 through which the characters erroneously inputted can be deleted. Through the operations of touching the key board. 241 and DELETE button 242, registration names can be inputted freely within a predetermined number of characters.

Characters inputted as registration names are displayed in a message area on the uppermost step, thus, the inputting state can be confirmed by the display for the input of registration names. After the completion of inputting, OK button 243 is touched.

After the OK button 243 has been touched, the condition pattern confirmed in terms of contents on the aforementioned check screen is stored, together with a given registration name, in the registration area number selected previously.

Incidentally, when the condition pattern is required to be registered with only the number and without necessity of setting the registration name, OK button 243 may be touched without taking any action when the JOB name registration screen shown in FIG. 21 is displayed. In this case, the registration name of the area is set automatically to "untitle" .

When the work is required to be discontinued on the half way of the registration work as mentioned above, AUTO/RESET button may be pressed.

On the other hand, when calling the condition pattern registered as stated above, JOB button 107 is to be pressed so that a JOB No. selection screen shown in FIG. 18 may be displayed, and then RECALL button 211 is to be touched thereon.

Figure 22:
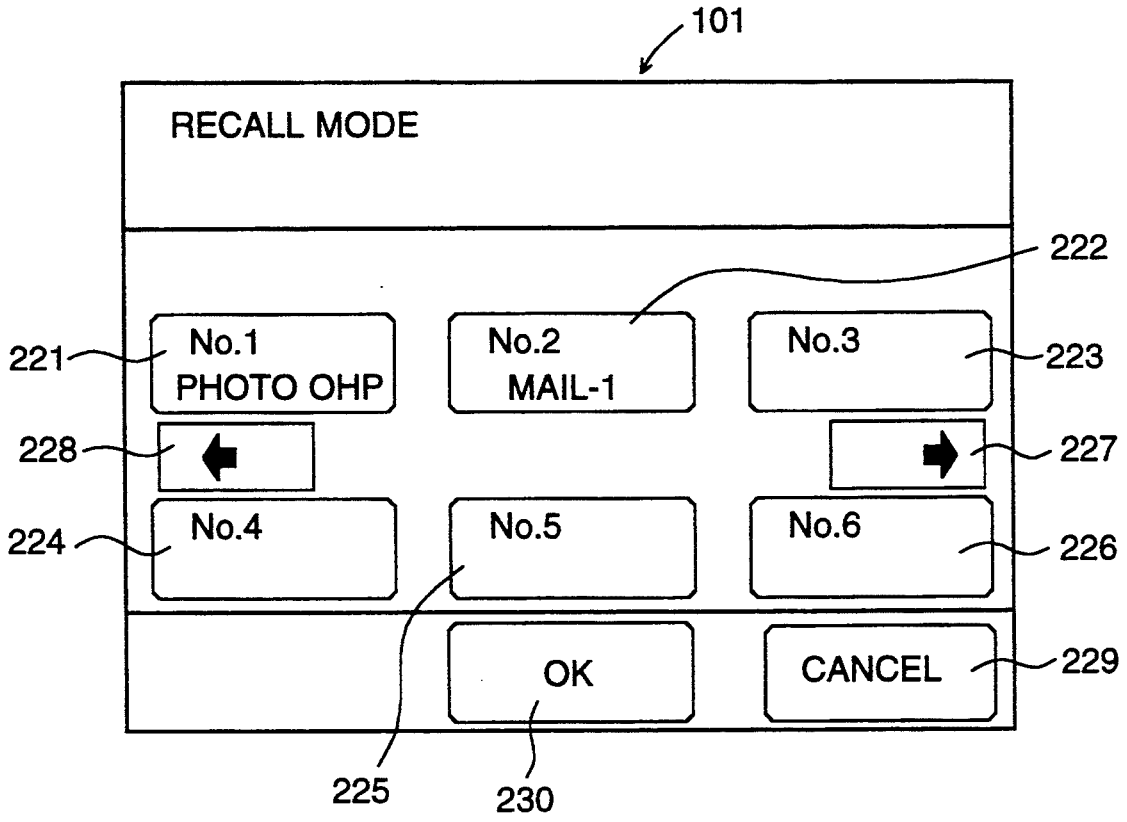
FIG. 22 is a diagram showing a JOB No.-selection screen on the occasion of an access.

Then, there are displayed, as shown in FIG. 22, the registration area buttons (No. 1 and No. 2 in FIG. 22) on each of which a number and a registration name inputted freely by touching a key board display in the course of registration are described. Therefore, the number with which the desired condition pattern is registered can be selected with the aforementioned area number and the registration name as a clue for retrieval, and the button corresponding to the number is touched.

Incidentally, on the area registered without inputting a registration name as stated above, there is set automatically the registration name of "untitle" and the characters of this "untitle" are described on a registration area button. Therefore, the registration area button on which no registration name is described can be judged to represent an area where no condition is registered. In this case, when an area button for the unregistered area is touched, an erroneous operation is indicated through a buzzer or an error message, while, when an area button for the registered area is touched, the display on the area button is reversed. After touching the area button for the registered area, when an area button for another registered area is touched, priority is given to the latter selection, and the former selection is canceled.

When the desired area button is selected from registered areas and touched and OK button 230 is further touched, the selected condition pattern mentioned above is set automatically and the screen is switched to the basic screen. When the contents of the registration are required to be confirmed before the automatic setting, check button 108 may be pressed.

When the check button 108 is pressed, there is displayed a check screen (a check screen having thereon a display in FIG. 20 plus registration names) which indicates registration numbers, registration names and various conditions registered corresponding thereto on a table. Therefore, it is possible, through the check screen, to judge whether there is an error on the condition pattern to be called or not.

When calling erroneously, CANCEL button 208 is be touched to cause the JOB No. selection screen to be displayed again so that another registration pattern may be called.

When storing copying conditions in a machine as stated above, a key board consisting of alphabets and numerals is displayed, and an operation of touching the key board gives a free name to a condition pattern to be registered as a registration name, and when calling, the desired condition pattern can be called by selecting using the registration name. Therefore, compared with registration of condition patterns only by means of the number for discrimination, the desired pattern can easily be selected when calling from a plurality of condition patterns registered.

Incidentally, it is recommended that the operation sound by means of a buzzer is produced when a button is operated on the operation panel mentioned above. Further it is recommended that when two or more different displayed buttons are touched simultaneously on LCD screen 101, the touching operation is made invalid.

Further, when copy button 102 is pressed for starting copying under the condition the initial screen is displayed, the initial screen (FULL-AUTOMATIC screen) in FIG. 8 is changed automatically to the basic screen in FIG. 9 and values determined by automatic selection mechanisms such as automatic density adjustment (AES), automatic paper selection (APS) and others are indicated on the screen. Further, after the completion of normal copying, automatic resetting function resets automatically to a full-automatic mode and the screen returns to the initial screen in FIG. 8 so that the following operation may not be interrupted.

As stated above, owing to the operation-panel-indicating method of the invention, an operation panel wherein a screen for setting various copying conditions is displayed on a screen that serves also as a touch panel on a changeover basis and a button on the displayed screen is touched for manual setting of the condition makes it possible to confirm simply the results of the manual setting because a screen displaying the conditions manually set on a table can be called. Further, when registering manually set condition patterns, a given registration name can be inputted through the display of a key board, and the inputted registration name can be used for calling as information. Therefore, the desired condition pattern can easily be called-from a plurality of condition patterns, which is advantageous. In addition, in the operation-panel-indicating method of the invention, buttons for indicating a setting screen for selecting the post processing for a copy sheet are provided outside a screen that serves also as a touch panel, and post processing conditions selected on the setting screen displayed on the screen are indicated as an indicator mark by the buttons mentioned above. Therefore, post processing conditions can be set through the simple constitution, and the conditions set can easily be confirmed, which is also advantageous.

What is claimed is:

1. A method of indicating a setting screen of an image forming apparatus comprising a touch panel, wherein copying conditions of said image forming apparatus, including magnification, copy density and paper size, can be selected by touching a button displayed on said setting screen, said method comprising;

displaying an initial screen indicating that a copy operation is ready to start in an automatic-setting mode, and a plurality of manual-setting mode selection buttons, each of which selects one of a plurality of manual-setting screens, wherein under said automatic-setting mode, magnification is set at an initial value, and copy density and paper size are automatically set depending on a document to be copied, and wherein each of said plurality of manual-setting mode selection buttons correlates to copying conditions which can be adjusted by touching one of a plurality of setting buttons displayed in each manual-setting screen, and changing said initial screen by touching one of said plurality of manual-setting mode selection buttons to indicate one of said plurality of manual-setting screens corresponding to a copying condition, each condition being controlled by one of said manual-setting mode selection buttons, wherein copying conditions selected by said manual-setting mode selection buttons can be manually set by touching one of said plurality of setting buttons on the displayed manual-setting screen, a plurality of buttons by which one of a plurality of functions of the image forming apparatus is selected, being provided on the displayed manual-setting screen, correlated buttons which cannot be used simultaneously in terms of functions selected thereby being displayed with indication showing such correlation.

2. A method of indicating a setting screen of an image forming apparatus comprising a touch panel, wherein copying conditions of said image forming apparatus, including magnification, copy density and paper size, can be selected by touching a button displayed on said setting screen, said method comprising;

displaying an initial screen indicating that a copy operation is ready to start in an automatic-setting mode, and a plurality of manual-setting mode selection buttons, each of which selects one of a plurality of manual-setting screens, wherein under said automatic-setting mode, magnification is set at an initial value, and the copy density and paper size are automatically set depending on a document to be copied, and wherein each of said plurality of manual-setting mode selection buttons correlates to copying conditions which can be adjusted by touching one of a plurality of setting buttons displayed on each manual-setting screen, and changing said initial screen by touching one of said plurality of manual-setting mode selection buttons to indicate one of said plurality of manual-setting screens corresponding to a copying condition, each condition being controlled by one of said manual-setting mode selection buttons, whereby copying conditions selected by said manual-setting mode selection buttons can be manually set by touching one of said plurality of setting buttons on the displayed manual-setting screen, wherein there is provided a memory to store plural groups of plural operating conditions and a keyboard including plural keys each correlating to one of said plural groups whereby one of said plural groups can be selected, operating conditions of the selected group being indicated, in a list, on a screen.

3. A method of indicating a setting screen of an image forming apparatus comprising a touch panel, wherein copying conditions of said image forming apparatus, including magnification, copy density and paper size, can be selected by touching a button displayed on said setting screen, said method comprising;

displaying an initial screen indicating that a copy operation is ready to start in an automatic-setting mode, and a plurality of manual-setting mode selection buttons, each of which selects one of a plurality of manual-setting screens, wherein under said automatic-setting mode, magnification is set at an initial value, and copy density and paper size are automatically set depending on a document to be copied, and wherein each of said plurality of manual-setting mode selection buttons correlates to copying conditions which can be adjusted by touching one of a plurality of setting buttons displayed on each manual setting screen, and changing said initial screen by touching one of said plurality of manual-setting mode selection buttons to indicate one of said plurality of manual-setting screens corresponding to a copying condition, each condition being controlled by one of said manual-setting mode selection buttons, wherein copying conditions selected by said manual-setting mode selection buttons can be manually set by touching one of said plurality of setting buttons on the displayed manual-setting screen, wherein an illustration of an arrangement of a plurality of paper trays in said image forming apparatus is displayed on the manual setting screen indicating paper size, a paper tray being selected by touch operation on said illustration.

4. The method of claim 1, after the image forming operation has been completed, the setting screen is returned to the initial screen.

5. The method of claim 2, wherein there is provided a check button to indicate a check screen on which set operating conditions are indicated in a list.

6. The method of claim 1, wherein a post process condition to deal with a paper delivered from an image forming process is set by a touch operation on one of the plurality of manual setting screens and the set post process condition is indicated as an indicator mark on the other manual setting screens.

7. The method of claim 1 wherein said initial value of said magnification and an indication of an automatically set copy density and paper size are displayed on said initial screen.

* * * * *